US005093058A

United States Patent [19]

Harmon et al.

[11] Patent Number: 5,093,058

[45] Date of Patent: Mar. 3, 1992

[54] APPARATUS AND METHOD OF MANUFACTURING SYNTHETIC BOARDS

[75] Inventors: David M. Harmon, Phoenix; Ted J. Bauer, Medford, both of Oreg.

[73] Assignee: Medite Corporation, Medford, Oreg.

[21] Appl. No.: 326,226

[22] Filed: Mar. 20, 1989

[51] Int. Cl.[5] ..... B27M 1/08; B27N 1/02

[52] U.S. Cl. ..... 264/115; 239/106; 239/432; 264/109; 264/120; 366/337; 425/200

[58] Field of Search ..... 264/109, 115, 120; 425/200; 239/106, 432; 366/177, 337

[56] References Cited

U.S. PATENT DOCUMENTS

| | | | |
|---|---|---|---|
| 2,199,087 | 4/1940 | Drill et al. | 65/10.2 |
| 2,757,115 | 7/1956 | Heritage | 428/338 |
| 2,757,150 | 7/1956 | Heritage | 523/326 |
| 2,872,337 | 2/1959 | Heritage et al. | 428/499 |
| 2,960,318 | 11/1960 | Caillaud | 366/177 |
| 3,179,341 | 4/1965 | Plos et al. | 239/106 |
| 3,190,618 | 6/1965 | Katzen | 366/337 |
| 3,297,603 | 1/1967 | Mase | 264/126 |
| 3,310,238 | 3/1967 | Bryant et al. | 239/132.3 |
| 3,428,592 | 2/1969 | Youker | 524/591 |
| 3,494,992 | 2/1970 | Wiegand | 264/121 |
| 3,636,199 | 1/1972 | Jenks et al. | 264/134 |
| 3,649,397 | 3/1972 | Peters | 156/62.2 |
| 3,752,398 | 8/1973 | Svensson | 239/1 |
| 3,874,990 | 4/1975 | Surdyk | 264/128 X |
| 3,914,498 | 10/1975 | Videen | 428/290 |
| 3,916,825 | 11/1975 | Schnitzler et al. | 118/303 |
| 3,919,017 | 11/1975 | Shoemaker et al. | 162/62.2 |
| 3,930,110 | 12/1975 | Shoemaker et al. | 428/424 |
| 3,949,904 | 4/1976 | Hendrickson | 239/432 X |
| 3,964,689 | 6/1976 | Horvath, Jr. | 239/432 X |
| 4,193,701 | 3/1980 | Koch et al. | 366/159 |
| 4,209,433 | 6/1980 | Hse | 524/595 |
| 4,279,788 | 7/1981 | Lambuth | 524/72 |
| 4,293,456 | 10/1981 | Reischl | 524/589 |
| 4,354,762 | 10/1982 | Cantoni | 366/160 |
| 4,396,673 | 8/1983 | Ball et al. | 428/326 |
| 4,402,896 | 9/1983 | Betzner et al. | 264/115 |
| 4,407,771 | 10/1983 | Betzner et al. | 264/115 |
| 4,435,234 | 3/1984 | Hunt | 156/62.4 |
| 4,453,670 | 6/1984 | Sirovy | 239/117 |
| 4,514,255 | 4/1985 | Maxwell et al. | 162/9 |
| 4,609,513 | 9/1986 | Israel | 264/122 |

FOREIGN PATENT DOCUMENTS

| | | | |
|---|---|---|---|
| 111149 | 8/1940 | Australia | 239/106 |
| 3510646 | 9/1986 | Fed. Rep. of Germany | 239/432 |
| 63-242332 | 10/1988 | Japan | 239/432 |

OTHER PUBLICATIONS

Gallagher, James, "Urethane Bonded Particleboard," *Forest Products Journal*, Apr., 1982, pp. 26–33.

Wilson, James, "Isocyanate Adhesives as Binders for Composition Board," *Adhesives Age*, May, 1981, pp. 41–44.

Chapman, Kelvin M., "Improved Uniformity in Medium Density Fiberboard," *Proceedings of Thirteenth Washington State Univ. Symposium on Particleboard*, Apr. (1979), pp. 237–253.

(List continued on next page.)

*Primary Examiner*—Mary Lynn Theisen

*Attorney, Agent, or Firm*—Klarquist, Sparkman, Campbell, Leigh & Whinston

[57] ABSTRACT

A method and apparatus for producing a synthetic board from cellulosic or lignocellulosic fibers is disclosed wherein a standard isocyanate binder is emulsified and immediately applied to the fibers before consolidation into a finished board product. The apparatus includes an emulsification and application nozzle comprising a diluent inlet, a binder inlet, a mixing section for emulsifying the diluent and the binder, and a spray nozzle for applying the binder/diluent emulsion to the fibers. The method includes supplying a binder stream, supplying a diluent stream, emulsifying the binder with the diluent and immediately applying the emulsion to the fibers. The method further includes flushing the binder/diluent emulsion using the diluent at the end of a binder application run to prevent curing of the emulsion and clogging of the apparatus. The present invention can be used to apply the binder/diluent emulsion to the fibers either in the blowline or downstream of the blowline, such as in the blender.

46 Claims, 2 Drawing Sheets

OTHER PUBLICATIONS

Loew, G. and Sachs, H., "Isocyanate as a Binder for Particleboard," *Proceedings of Eleventh Washington State Univ. Symposium on Particleboard,* Mar. (1977), pp. 473–492.

Gran, G., "Blowline Blending in Dry Process Fiberboard Production," *Proceedings of Sixteenth Washington State Univ. Symposium on Particleboard,* Mar. (1982), pp. 261–267.

Hammock, L., "Resin Blending of MDF Fiber," *Proceedings of Sixteenth Washington State Univ. Symposium on Particleboard,* Mar. (1982), pp. 245–259.

APPARATUS AND METHOD OF MANUFACTURING SYNTHETIC BOARDS

BACKGROUND OF THE INVENTION

1. Field of the Invention

The present invention relates to an apparatus and method of manufacturing synthetic boards from cellulosic or lignocellulosic furnish materials using an organic binder.

2. Description of the Prior Art

Many synthetic board products are manufactured using a thermosetting binder, heat and pressure to reconsolidate refined cellulosic and/or lignocellulosic furnish materials into a unitary finished board product. Examples of board manufacturing processes are shown in U.S. Pat. No. 2,757,115 to Heritage and U.S. Pat. No. 4,407,771 to Betzner et al. Basically, furnish material, such as wood, is reduced to fibers of the desired size by a refiner, mixed with a binder and other chemicals such as release and sizing agents, partially dewatered, formed into mats and compressed between heated platens in a hot press to form a board product of the desired thickness and density. In many current processes, the binder is applied to a rapidly moving stream of the fibers as it exits the refiner, in the so-called "blowline" of the process equipment. Alternatively, the binder may be added in the blender or elsewhere downstream of the refiner.

A wide variety of binder systems have been utilized in the production of synthetic boards, including various thermosetting organic binders, such as isocyanates, polyisocyanates, urea formaldehydes, phenolics, melamines and various mixtures thereof. Isocyanate and polyisocyanate binders have advantages over urea formaldehyde binders in that boards with greatly improved weather resistance can be produced. Processing time can typically be substantially reduced using isocyanate and polyisocyanate binders rather than standard phenolic binders. Although specially formulated phenolic binders can decrease the processing time, the cost of these specialty binders makes their use less attractive. Additionally, urea formaldehyde binders tend to produce formaldehydes, and phenolic binders tend to produce both formaldehydes and free phenols around the press area, which can cause significant health problems.

Heretofore, successful application of isocyanate binders in fiberboard manufacture has been limited due to many factors. First, there is often difficulty in achieving adequate distribution at low dosage rates. Second, many systems require the use of an expensive release agent-containing binder or must utilize a caul plate system which allows external release agent application. These problems usually result in increased production costs and/or inferior finished board product quality.

Many of the binder systems used today in board manufacture include an organic isocyanate binder which is specially mixed with a variety of diluent/extender agents to enhance binder distribution. These admixtures must also have a relatively long pot life to avoid premature curing, which can clog the binder delivery system. Unfortunately, even quite stable admixtures tend to deposit reaction products in process lines during use, and especially when use is interrupted. Both problems usually necessitate expensive machine downtime to unclog or replace components of the binder delivery system.

In systems utilizing isocyanate binders, the binder is typically formulated into an aqueous emulsion long before application to the furnish. Since the binder is highly reactive, the temperature during and after emulsification must be kept relatively low to avoid prereaction of the binder before it is applied to the furnish materials. Water-cooled addition devices, such as the nozzle described in U.S. Pat. No. 4,402,896 to Betezner et al have been used, but require a constant supply of cooling water and are still subject to clogging.

Another problem associated with specialty binders and their mixing equipment is that if the binder is not completely removed from the binder delivery system at the end of a production run, the binder will usually cure and clog the system. Therefore there is a need for a binder delivery system which assures that all of the binder is removed therefrom to avoid these problems.

Additionally, release agents are often added to the binder system to avoid sticking of the board to platens or caul plates during processing. However, these specially formulated binders are typically proprietary to a particular manufacturer and are prohibitively expensive for large-scale fiberboard manufacturing operations. Accordingly, there is a need for a process and apparatus which can utilize basic non-proprietary isocyanate and other binder compounds and release agents.

It is therefore an object of the present invention to provide a method of producing a synthetic board from cellulosic or lignocellulosic materials wherein standard, nonproprietary, inexpensive and readily available isocyanate, polyisocyanate and similar binders can be utilized, thus obviating the need for expensive specialty chemical formulations.

It is also an object of the present invention to provide an apparatus for producing a synthetic board wherein standard binders and release agents can be utilized.

It is a further object of the present invention to provide a method and an apparatus for forming a binder emulsion immediately upstream from the point of application to the wood fibers, thus allowing the use of isocyanates or polyisocyanates which do not form emulsions having extended stabilities or pot life.

It is also an object of the present invention to provide a method and apparatus for binder application wherein the emulsion is cooled by the diluent.

It is an object of the present invention to provide a method and apparatus for applying the binder which would avoid periodic plugging of the process equipment and the binder system.

It is also an object of the present invention to provide a method and apparatus for flushing the binder from the nozzle at the end of a production run so that the binder does not cure within the nozzle and clog the same.

SUMMARY OF THE INVENTION

The present invention is a method and apparatus for producing a synthetic board from cellulosic or lignocellulosic fibers wherein a standard thermosetting binder is emulsified and immediately applied to the fibers before consolidation of the fibers into a finished board product. The apparatus includes a binder emulsification and application nozzle comprising a diluent inlet, a binder inlet, a mixing section for emulsifying the diluent and the binder, and a spray nozzle for applying the binder/diluent emulsion to the fibers in a fiber stream upstream of the forming mat in the board forming process. The method includes supplying a binder stream, supplying a diluent stream, merging the two streams, emulsifying the binder with the diluent and immediately thereafter applying the emulsion to the fiber stream. The method further includes flushing the nozzle with the diluent stream at the end of a production run to remove the binder from the nozzle to prevent curing of the binder emulsion and clogging of the nozzle. In the apparatus of the present invention, the nozzle can be used to apply the emulsified binder to the fiber stream either in the refiner, the blowline or downstream of the blowline, such as in the blender, of the board forming apparatus.

DETAILED DESCRIPTION OF THE PREFERRED EMBODIMENTS

Figure 1:
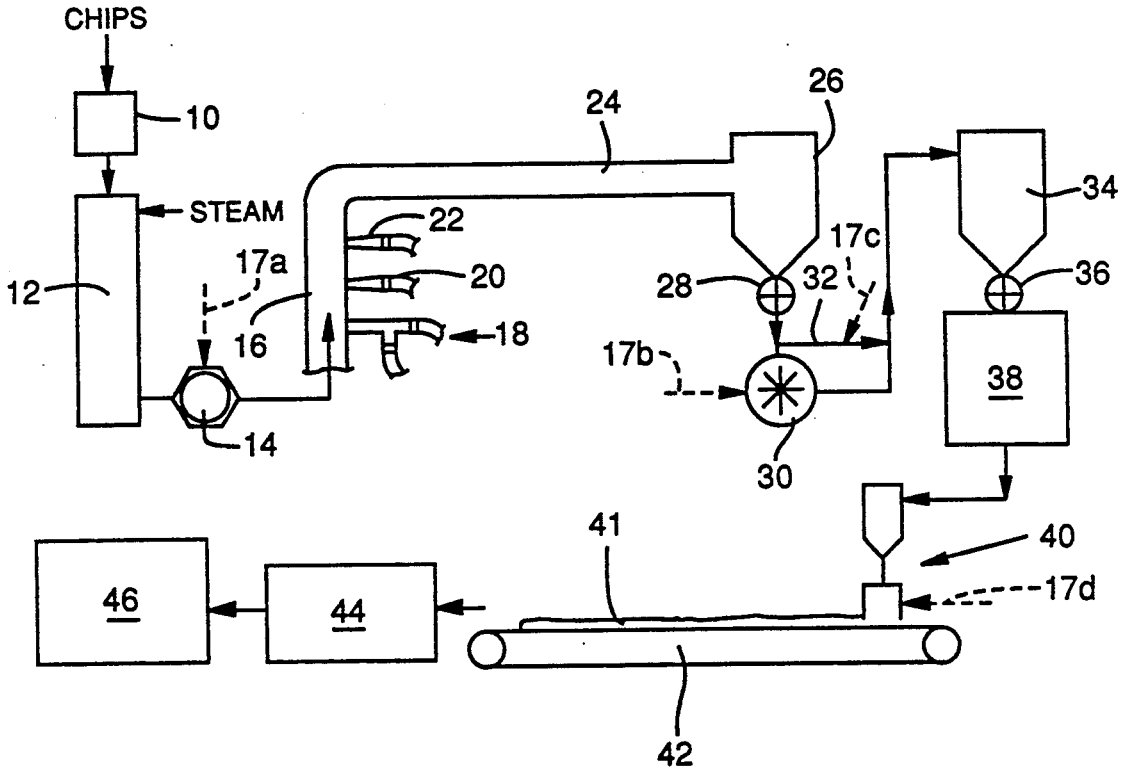
FIG. 1 is a schematic diagram showing the process and apparatus in accordance with the present invention.

The present invention is intended for use in the production of reconstituted products made from cellulosic or lignocellulosic materials, and in particular, the production of fiberboard from wood fibers. As shown in FIG. 1, pieces of wood, such as chips, are fed into a plug feeder 10 for delivery to a digester 12, where they are subjected to steam and high pressure to soften the chips and break down the lignin therein. The cooked chips are transferred to a refiner 14 where they are separated into their constituent fibers, such as between uni- or bi-directional rotating discs.

The hot and wet fibers exit refiner 14 with steam in a rapidly moving continuous stream which is transported through a so-called "blowline" 16, where the binder and other desired compounds, such as release and sizing agents, are typically added. The binder is preferably a material selected from the group consisting of monomeric isocyanates, oligomeric isocyanates, and mixtures thereof having a functionality of at least 2. In addition, other conventional thermosetting binders may be used.

Aqueous emulsions of the binder and other additives are well-suited to blowline injection for several reasons. First, a large portion of the heat energy available in the blowline is absorbed in raising the temperature of the applied emulsions since the specific heat of water is higher than many of the other substances being added. Second, the water-to-water solvent compatibility between the wood fibers an the additive emulsion is excellent and helps assure good flow and distribution of the binder. Third, deposits of the additive emulsion on the wall of the blowline are minimized due to the presence of a continuous film of water condensate, with which the additive emulsions are also compatible. Fourth, the great turbulence within the blowline results in a scouring action which tends to keep the blowline wall clean, providing those adhering substances are also water compatible. Lastly, the residence time in the blowline is so short that most chemical reactions, such as curing of the binder, have insufficient time and energy to move very far toward reaction products.

In the preferred embodiment of the present invention, a binder emulsion and application nozzle assembly 18 in accordance with the present invention is connected to blowline 16 for emulsifying the binder with a diluent and applying the resulting emulsion to the fibers as they pass through blowline 16. In the preferred embodiment, conventional nozzles 20 and 22 are also plumbed to blowline 16 for applying release and sizing agents to the fibers. Alternatively, the binder, release agent and sizing agents may be added at other locations in the process, as will be described below.

Upon entering blowline 16, the steam and the fibers undergo a rapid drop in pressure and temperature, but travel therethrough in less than about 1 second. The velocity of the fibers through a typical blowline has been reported to be approximately 325 feet per second. There is extreme turbulence in blowline 16, which provides excellent mixing of additives, such as the binder, with the fibers.

After exiting blowline 16, the fibers enter a dryer 24 where they are partially dewatered. A first cyclone 26 and an air lock 28 are provided to separate the fiber from the dryer airstream. The fibers next pass to a blender 30 wherein the binder, sizing, release agents or other desired materials can be mixed with the fibers, if desired. If all desired compounds have already been added, the fibers can be directed through a bypass chute 32 and go directly to a second cyclone 34 with an air lock 36 and then into a fiber storage bin 38. Fiber storage bin 38 provides fibers to one or more forming head apparatuses 40 which are used to dispense a forming mat of fibers 41 onto a forming belt 42. Forming mat 41 is deaerated by one or more prepresses 44 and then compressed to the final pressed thickness by a hot press 46 wherein the binder is cured to form the desired board product.

In general, the binder can be added to the fibers in any suitable location in the board forming apparatus upstream of forming mat 41. Alternative locations where the binder can be added to the fibers are designated by dashed arrows 17*a–d* in FIG. 1. For example, the binder may be added using the nozzle assembly of the present invention in any of the following locations: refiner 14; blender 30; bypass chute 32 or forming head apparatuses 40. Similarly, the sizing and release agents can be added, separately or together, in the various locations in the board forming apparatus, including: plug feeder 10, digester 12, refiner 14, blowline 16, blender 30 or bypass chute 32.

Figure 2:
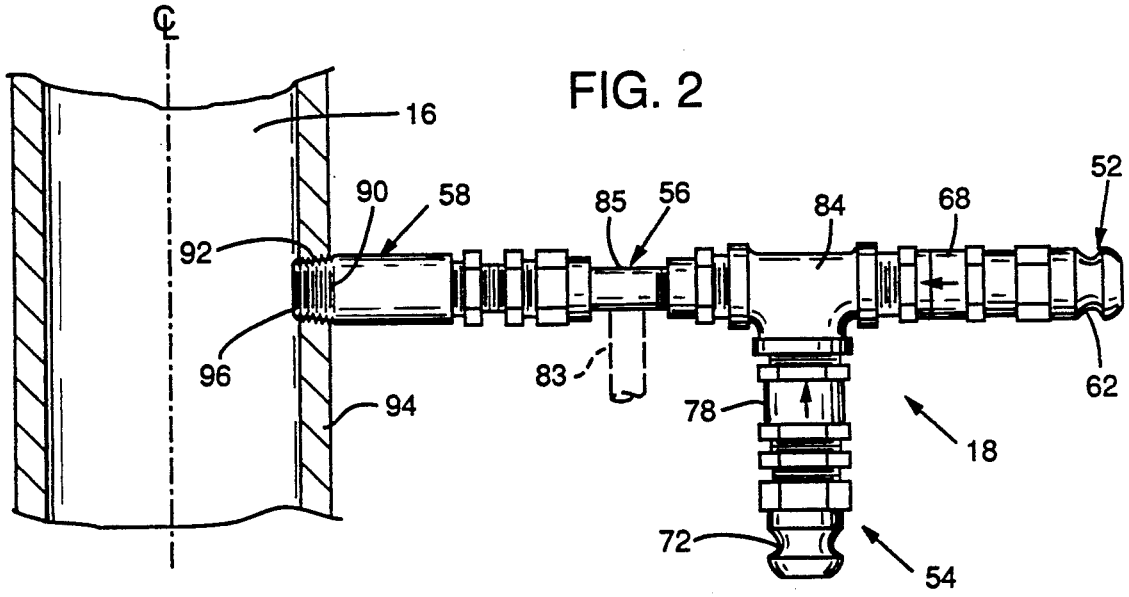
FIG. 2 is a side view of a nozzle in accordance with the present invention mounted on a blowline of a fiberboard manufacturing process.
Figure 3:
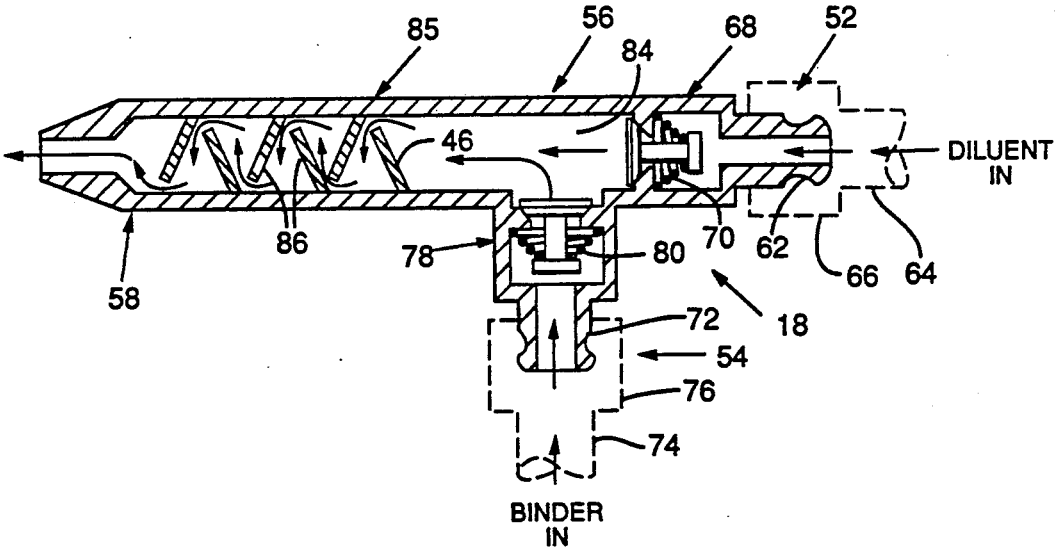
FIG. 3 is a schematic view of the nozzle in accordance with the present invention.

Referring to FIGS. 2 and 3, nozzle assembly 18 comprises a diluent inlet 52, a binder inlet 54, a mix section 56 for emulsifying diluent and binder and a spray nozzle 58 adapted for connection to a blowline 16 for spraying the emulsion on the fibers. A stream of water or other diluent is introduced through diluent inlet 52, and a stream of a binder, which can be isocyanate, polyisocyanate or other suitable thermosetting binder, is introduced through binder inlet 54.

Diluent inlet 52 includes a coupling 62, such as a quick disconnect coupling shown, for connection to a diluent supply line 64 with an appropriate coupling 66 through which water or other suitable diluent is delivered to nozzle assembly 18. A pressure relief check valve 68 for diluent inlet 52 is operated by a control spring 70 and is threadedly connected to coupling 62. Diluent check valve 68 prevents backflow from mix section 56 into diluent supply line 64. In addition, diluent check valve 68 will only open to allow diluent into mix section 56 when the pressure of the water stream is above a certain minimum pressure, for example, 15 psi. This assures that there will be no admixing of water and binder until the water stream has achieved proper operating pressure, such as by the use of an appropriate metering pump (not shown). It also assures that the flow of diluent into nozzle assembly 18 will stop immediately upon stopping the flow of the diluent stream or upon a drop in the pressure of the stream. Suitable check valves are available from the NuPro Company of Willoughby, Ohio.

Although alternative diluents, such as propylene carbonate or furfural, can be used under various conditions, water has long been used to reduce the viscosity of binders and thus improve distribution. The water also serves as a thermal buffer for the binder. This is particularly significant for those applications utilizing blowline addition of isocyanates. Since there is a constant flow of relatively cool (less than ambient temperature) diluent water through nozzle assembly 18, the temperature to which the binder is subjected during emulsification is also less than ambient, which prevents precuring. No additional cooling of the emulsion, such as provided by a cooling water jacket, is required.

Binder inlet 54 similarly includes a coupling 72 for connection to a binder supply line 74 with a coupling 76 through which binder is delivered to nozzle assembly 18. In the preferred embodiment, the binder is standard technical grade isocyanate or polyisocyanate. A pressure relief check valve 78 for binder inlet 54 includes a control spring 80 and is threadedly connected to coupling 72. Binder check valve 78 operates as above to prevent backflow from mix section 56 into binder supply line 74. Binder check valve 78 also prevents the admixing of water and binder before the binder stream has achieved its proper operating pressure, or if the flow of the binder stream has been stopped or if the pressure of the binder stream drops below a proper operating pressure.

Figure 4:
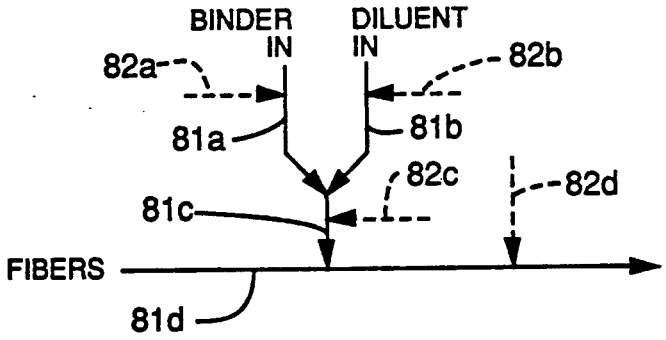

Additional compounds, such as release agents, sizing agents, etc., may be applied to the fibers, if desired. Referring to FIG. 4, release agents and sizing agents may be added, separately or together, to diluent stream 81*a*, binder stream 81*b*, combined binder/diluent stream 81*c* or directly to fiber stream 81*d*, as shown by dashed lines 82*a*–82*d*, respectively. If the additional compounds are to be added to combined binder/diluent stream 81*c*, a third inlet 83 (shown by dashed lines in FIG. 2) can be plumbed to mix section 56 of nozzle assembly 18 for introducing such compounds into mix section 56. In this way, the additional compound will be merged with the binder/diluent immediately before application to the fibers.

Mix section 56 includes an intersecting tee 84 which is threadedly attached to the outlets of diluent check valve 68 and binder check valve 78 for receiving the binder stream and the diluent stream. Tee 84 is also threadedly connected to an in-line mix section 85 equipped with a plurality of interior baffles 86 which cause mixing and emulsion of the binder with the diluent. The exact number and configuration of baffles 86 has not been found to be critical, as long as sufficient mixing results. A plastic baffled-style motionless mixer insert sized of insertion into in-line mix section 85 and sold by TAH Industries of Imalyston, N.J. under the name Kinetic Mixer has been found to give good results.

Spray nozzle 58 is threadedly attached to in-line mix section 85 for applying the diluent-binder emulsion to the fibers passing through blowline 16. Spray nozzle 58 is provided with external threads 90 for attachment to mating internal threads 92 in wall 94 of blowline 16. Spray nozzle 58 is mounted so that only a small tip portion 96 of the nozzle 90 extends into blowline 16 and is subjected to the abrasive atmosphere therein. Due to the abrasive atmosphere of blowline 16 and to avoid any possible interaction with the emulsion, it has been determined that spray nozzle 58 should be constructed out of stainless steel or other suitable material.

It has also been determined that a spray nozzle obtained from Spraying Systems Company of Wheaton, Ill. and sold under the trademark FULLJET gives good results. This nozzle tip includes an integral interior spiral vane mixer which produces a full cone spray pattern for good distribution of the emulsion on the fibers. It has also been determined that a nozzle I.D. of 0.245 inches is preferred to maintain proper backpressure in nozzle assembly 18. Nozzle assembly 18 is typically operated at an emulsion flow rate of approximately 5 gallons per minute and a pressure of between 80 and 125 psi, although some applications may require other application rates and parameters.

In the preferred embodiment, blowline 16 has an interior diameter of about 6 inches. Thus, the distance between the point of emulsification of the binder and the point of application to the fibers in blowline 16 is very small, approximately 4 inches. This relatively short distance helps assure that the binder emulsion does not cure before application to the fibers.

In accordance with the present invention, a method of and means for flushing binder and emulsion out of nozzle assembly 18 are also provided. This flushing is necessary to avoid leaving the emulsion in mix section 56 or spray nozzle 58 where it could quickly cure and plug nozzle assembly 18. To flush nozzle assembly 18 at the end of a production run, the binder pump should be turned off to stop the flow of binder. This causes binder check valve 78 to close. The water stream is allowed to continue to flow for a few seconds (3–5 seconds) to flush out any residual emulsion. Preferably, the binder stream should be shut off before fiber stream flow past spray nozzle 58 has ended to avoid buildup of binder in blowline 16.

Application of the aqueous emulsions of standard isocyanate and polyisocyanate through nozzle assembly 18 into blowline 16 results in a practical and economical means of producing a superior fiberboard product. The ready availability of the binders are of great significance to a commercial fiberboard production facility.

Although preferred embodiments of the present invention have been shown, it is obvious than many modifications and variations of the present invention are possible in light of the above teachings. It is therefore to be understood that the present invention may be practiced otherwise than as specifically described.

We claim:

1. In the production of synthetic boards from cellulosic fibers and a highly reactive multi-part binder system including a binder and a binder diluent, an apparatus adapted for mixing a binder stream and a diluent stream and applying the resulting product stream to the fibers, the apparatus comprising:

conduit means for transporting a stream of fibers;

binder inlet means adjacent the conduit means for receiving a first stream containing a binder;

diluent inlet means adjacent the conduit means for receiving a second stream containing a diluent;

mixing means including a mixing means inlet fluidly connected to and adjacent the binder inlet means and the diluent inlet means for mixing the first stream and the second stream to produce a third stream containing a product comprising a mixture of the binder and the diluent; and continuously open outlet means positioned proximate the mixing means and proximate the conduit means and fluidly connected to the mixing means and opening into the interior of the conduit means for immediately applying the third stream to the stream of fibers.

2. The apparatus of claim 1 including a binder control valve at the binder inlet means and a diluent control valve at the diluent inlet means, said valves being fluid pressure operated to open by the respective downstream pressures of said first and second streams of binder and diluent flowing in directions toward said mixing means and thereby allow the first and second streams to flow through the inlet means into said mixing means, said binder and diluent valves being closable, respectively, in response to a reduction in the downstream pressures applied by said first and second streams.

3. The apparatus of claim 1 wherein said mixing means comprises an in-line static mixer.

4. The apparatus of claim 2 including means for flushing said mixing means comprising means for maintaining downstream pressure on said diluent control valve to maintain the diluent control valve open while reducing the downstream pressure on said binder control valve to close the binder valve.

5. In the production of synthetic boards from cellulosic fibers, an apparatus adapted for mixing a binder stream and a diluent stream and applying a product stream to the fibers, the apparatus comprising:

binder inlet means for receiving a first stream containing a binder;

diluent inlet means for receiving a second stream containing a diluent;

mixing means fluidly connected to the binder inlet means and the diluent inlet means for mixing the first stream and the second stream to produce a third stream containing a product comprising the binder and the diluent;

outlet means positioned proximate the mixing means and fluidly connected to the mixing means for immediately applying the third stream to the fibers; and flush means for flushing the mixing means with the second stream after flow of the first stream is stopped.

6. The apparatus of claim 5 wherein the binder inlet means comprises binder control valve means for automatically stopping the flow of the first stream upon a decrease in application pressure thereof.

7. The apparatus of claim 5 wherein the diluent inlet means comprises diluent control valve means for automatically stopping the flow of the second stream upon a decrease in application pressure thereof.

8. The apparatus of claim 5 wherein the mixing means emulsifies the binder and the diluent in the third stream.

9. The apparatus of claim 5 wherein the mixing means comprises a plurality of baffles.

10. The apparatus of claim 5 wherein the outlet means comprises a spray nozzle.

11. The apparatus of claim 5 wherein the flush means comprises means for first stopping flow of the first stream and then stopping flow of the second stream.

12. The apparatus of claim 5 and further comprising:

supplemental inlet means fluidly connected to the mixing means for receiving a fourth stream, wherein the fourth stream is mixed with the first stream and the second stream in forming the third stream.

13. The apparatus of claim 5 wherein said flush means includes a fluid pressure operated binder control valve at the binder inlet means and a fluid pressure operated diluent control valve at the diluent inlet means, said valves being independently operable to open and close upon variations in the applied pressures of said first and second streams.

14. An apparatus for producing synthetic boards from a cellulosic material, and a highly reactive multi-part binder system including a binder and a diluent comprising:

refining means for extracting fibers from a cellulosic material;

conduit means connected to the refining means for conveying the fibers along a fiber flow path;

binder application means for mixing a binder and a diluent to form a binder/diluent mixture and immediately mixing the binder/diluent mixture with the fibers in the fiber flow path;

said binder application means including a static in-line mixing section having a continuously open outlet end connected to said conduit means and opening into the interior of the conduit means and a continuously open inlet end, binder inlet means connected to said inlet end, and diluent inlet means connected to said inlet end, such that a binder stream and a diluent stream merge at the inlet end, mix in the mixing section and merge with the fiber stream at the outlet end;

dryer means for partially dewatering the fiber/binder mixture;

forming means for creating a mat of the dewatered fiber/binder mixture; and heated pressing means for compressing the fibers and curing the binder in the mat for forming a consolidated board product.

15. The apparatus of claim 14 including a first check valve at the binder inlet means and a second check valve at the diluent inlet means, the first and second check valves being independently operable under the influence of the binder and diluent streams to permit binder and diluent flow into the mixing section but prevent backflow thereof from the mixing section.

16. The apparatus of claim 15 including flush means for flushing the mixing section, said flush means including the check valves.

17. An apparatus for producing synthetic boards from a cellulosic material, comprising:

refining means for extracting fibers from a cellulosic material;

conduit means connected to the refining means for conveying the fibers along a fiber flow path;

binder application means for mixing a binder and a diluent to form a binder/diluent mixture and immediately mixing the binder/diluent mixture with the fibers in the fiber flow path;

dryer means for partially dewatering the fiber/binder mixture;

forming means for creating a mat of the dewatered fiber/binder mixture;

heated pressing means for compressing the fibers and curing the binder and the mat for forming a consolidated board product; and flush means for flushing the binder/diluent mixture from the binder application means at the end of a production run wherein the flush means comprises means for stopping the flow of binder from the first stream and then stopping the flow of diluent from the second stream.

18. The apparatus of claim 17 wherein the binder application means comprises:

binder inlet means for receiving a first stream containing a binder;

diluent inlet means for receiving a second stream containing a diluent;

mixing means fluidly connected to the binder inlet means and the diluent inlet means for mixing the binder and the diluent to produce a mixed product stream thereof; and outlet means positioned proximate the mixing means and fluidly connected to the mixing means for immediately applying the emulsion to the fibers in the fiber flow path.

19. The apparatus of claim 18 wherein the binder inlet means comprises binder control valve means for automatically stopping the flow of the binder stream upon a decrease in application pressure thereof.

20. The apparatus of claim 18 wherein the diluent inlet means comprises diluent control valve means for automatically stopping the flow of the diluent stream upon a decrease in application pressure thereof.

21. The apparatus of claim 18 wherein the mixing means comprises an in-line mixer.

22. The apparatus of claim 18 wherein the mixing means comprises a plurality of baffles.

23. The apparatus of claim 18 wherein the outlet means comprises a spray nozzle.

24. The apparatus of claim 17 wherein the binder/-diluent mixture is mixed with the fibers upstream of the forming means.

25. The apparatus of claim 17 wherein the conduit means comprises a blender means positioned along the fiber flow path for receiving and mixing the fibers, wherein the binder application means is plumbed to the blender means for applying binder to the fibers therein.

26. The apparatus of claim 17 wherein the conduit means comprises a blowline means wherein the binder application means is plumbed to the blowline means for applying binder to the fibers therein.

27. In the manufacture of synthetic boards from cellulosic fibers, a method of blending a binder with the fibers, the method comprising:

conveying cellulosic fibers in a first stream;

conveying a binder in a second stream;

conveying a diluent in a third stream;

merging the second stream and the third stream to produce a fourth stream;

immediately thereafter merging the fourth stream and the first stream to apply the binder and the diluent to the fibers; and flushing the fourth stream at the end of a production run using the third stream after flow of the second stream is stopped.

28. The method of claim 27 and further comprising the step of:

mixing the second stream and the third stream to produce a binder/diluent mixture in the fourth stream.

29. The method of claim 28 and further comprising the step of:

emulsifying the binder/diluent mixture immediately before merging the fourth stream with the first stream.

30. The method of claim 29 wherein the binder/diluent mixture in the fourth stream is emulsified by forcing said stream through a plurality of baffles.

31. The method of claim 27 and further comprising the step of:

conveying a release agent in a fifth stream;

merging the fifth stream with the second and third streams immediately before merging the fourth stream and the first stream.

32. The method of claim 27 and further comprising the step of:

conveying a sizing agent in a fifth stream;

merging the fifth stream with the second and third streams immediately before merging the fourth stream and the first stream.

33. The method of claim 27 wherein the binder comprises a thermosetting binder.

34. The method of claim 27 wherein the binder comprises a material selected from the group consisting of monomeric isocyanates, oligomeric isocyanates and mixtures thereof having a functionality of at least 2.

35. The method of claim 27 wherein the diluent comprises water.

36. The method of claim 27 wherein the binder comprises a thermosetting binder and the diluent comprises water.

37. A method of producing synthetic boards from a cellulosic material, comprising the steps of:

extracting hot and wet fibers from a cellulosic material;

transporting the hot and wet fibers in a first stream;

transporting separate second and third streams comprising a binder and a diluent, respectively, generally toward the first stream;

merging the second and third streams to form a fourth stream;

emulsifying the binder and the diluent in the fourth stream;

immediately after emulsifying, applying the binder/-diluent emulsion in the fourth stream to the hot and wet fibers in the first stream;

partially dewatering the hot and wet fibers;

forming the partially dewatered fibers into a mat;

compressing the mat in a heated press to cure the binder to form a consolidated board product; and flushing the binder/diluent emulsion using the third stream after flow of the second stream is stopped.

38. The method of claim 39 wherein the emulsifying step comprises:

conveying the merged binder and diluent in the fourth stream around stationary baffles in the fourth stream to intermix and emulsify the binder and the diluent.

39. The method of claim 37 wherein the binder comprises a thermosetting binder.

40. The method of claim 37 wherein the binder comprises a material selected from the group consisting of monomeric isocyanates, oligomeric isocyanates and mixtures thereof having a functionality of at least 2.

41. The method of claim 37 wherein the diluent comprises water.

42. The method of claim 37 wherein the binder comprises a thermosetting binder and the diluent comprises water.

43. The method of claim 37 wherein the second stream further comprises a sizing agent.

44. The method of claim 37 wherein the second stream further comprises a release agent.

45. The method of claim 37 wherein the third stream further comprises a sizing agent.

46. The method of claim 37 wherein the third stream further comprises a release agent.

* * * * *

UNITED STATES PATENT AND TRADEMARK OFFICE

CERTIFICATE OF CORRECTION

PATENT NO. : 5,093,058

DATED : March 3, 1992

INVENTOR(S) : David M. Harmon, Ted J. Bauer

It is certified that error appears in the above-identified patent and that said Letters Patent is hereby corrected as shown below:

Column 2, line 6

"Betezner" should be --Betzner--; and

Column 3, line 49

"an" should be --and--.

Signed and Sealed this

Twenty-eighth Day of December, 1993

*Attest:*

BRUCE LEHMAN

*Attesting Officer*

*Commissioner of Patents and Trademarks*